US009009926B2

(12) United States Patent
Ehrsam et al.

(10) Patent No.: US 9,009,926 B2
(45) Date of Patent: Apr. 21, 2015

(54) PORTABLE OBJECT WITH AN INTERCHANGEABLE BRACELET OR STRAP

(75) Inventors: Nicolas Ehrsam, Evilard (CH); Laurie Saunders, Cormondreche (CH)

(73) Assignee: Tissot S.A., Le Locle (CH)

( * ) Notice: Subject to any disclaimer, the term of this patent is extended or adjusted under 35 U.S.C. 154(b) by 8 days.

(21) Appl. No.: 12/947,297

(22) Filed: Nov. 16, 2010

(65) Prior Publication Data

US 2011/0113599 A1 May 19, 2011

(30) Foreign Application Priority Data

Nov. 17, 2009 (EP) ..... 09176225

(51) Int. Cl.
*A44B 11/25* (2006.01)
*G04B 37/14* (2006.01)
*A44C 5/14* (2006.01)

(52) U.S. Cl.
CPC ..... *G04B 37/1486* (2013.01); *A44C 5/14* (2013.01)

(58) Field of Classification Search
USPC ..... 24/265 R, 265 WS, 573.11, 700; 224/180
See application file for complete search history.

(56) References Cited

U.S. PATENT DOCUMENTS 3,908,243 A * 9/1975 Lou et al. ..... 24/653
4,605,312 A * 8/1986 Sellier ..... 368/282
5,483,505 A * 1/1996 Cartier ..... 368/282
5,557,587 A * 9/1996 Tosaka et al. ..... 368/282
6,014,793 A * 1/2000 Howald ..... 24/265 B
7,526,840 B2 * 5/2009 Pernu et al. ..... 24/265 WS
8,007,165 B1 * 8/2011 Lalo ..... 368/282

FOREIGN PATENT DOCUMENTS

CH 518 697 A 1/1970
CH 654713 A3 3/1986
EP 1 128 237 A1 2/2000
EP 1 995 651 A2 11/2008
GB 933969 A 8/1933

* cited by examiner

*Primary Examiner* — Robert J Sandy
*Assistant Examiner* — David Upchurch
(74) *Attorney, Agent, or Firm* — Sughrue Mion, PLLC

(57) ABSTRACT

The present invention concerns a portable object including a case (2) and a bracelet or strap (14). The case includes a middle part (4) from which two pairs of horns (12) extend, the horns of each pair being connected by a guide element (50) defining a space in conjunction with the middle part. The portable object includes securing means (18) including a locking part (20, 20') inserted in each end (30) of the bracelet or strap and at least one groove (22) located on the middle part (4). The securing means (18) is arranged to enable each end of the bracelet or strap to be inserted in the space defined by the middle part and the horns of each pair connected by the guide element (50), such that the locking part (20) cooperates elastically with said groove to secure said bracelet or strap to the case in a simple manner.

17 Claims, 4 Drawing Sheets

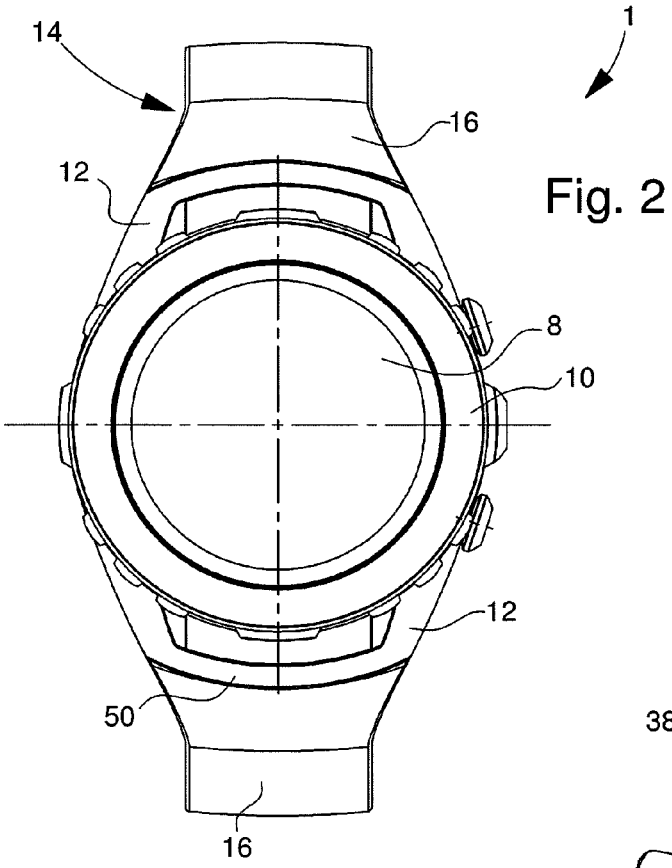
Fig. 2
Fig. 3
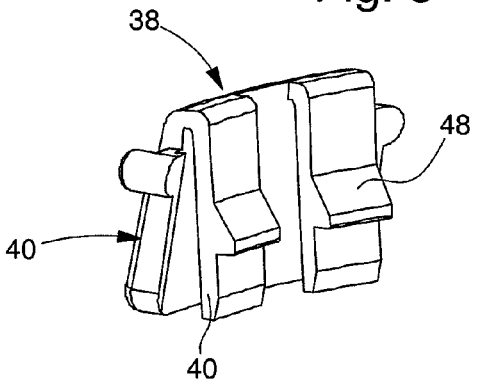
Fig. 4
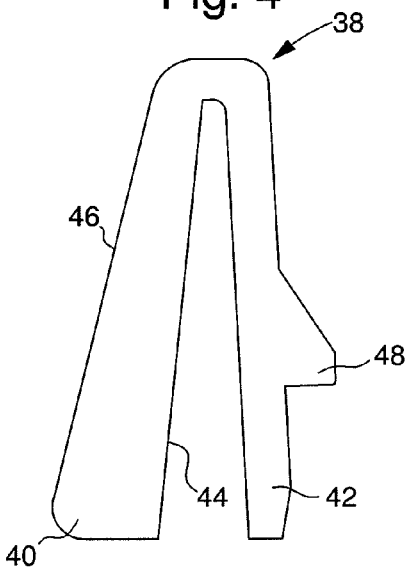
Fig. 5
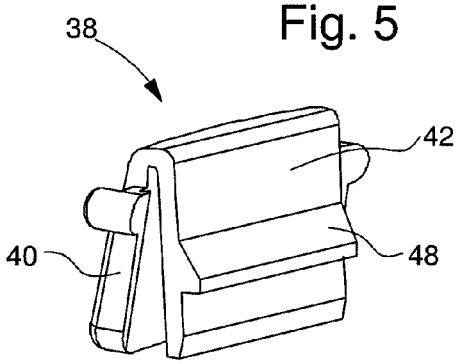

PORTABLE OBJECT WITH AN INTERCHANGEABLE BRACELET OR STRAP

This application claims priority from European Patent Application No. 09176225.2 filed Nov. 17, 2009, the entire disclosure of which is incorporated herein by reference.

The present invention concerns a portable object including a case and a bracelet or strap. The case includes a middle part from which two pairs of horns extend. The horns of each pair are connected by a guide element defining a space in conjunction with the middle part.

BACKGROUND OF THE INVENTION

Watches which are secured to the user's wrist by a bracelet or strap are known in the prior art. The bracelet or strap, which may made of leather, rubber or metal, is connected to the pairs of horns of the watch via metal pins secured to said horns.

The disadvantage of these bracelets or straps is that they cannot be changed by the user himself. In fact, if the user wants to change the bracelet or strap because of wear or for aesthetic reasons, he is generally obliged to go to a professional in order to carry out the replacement operation. This operation requires time and involves some cost.

Portable objects provided with interchangeable bracelets or straps are also known from the prior art, as shown in FIG. 7. One of these systems 100 uses a pivoting spring mechanism. To achieve this, an inclined cover 101 is arranged between the horns. This cover 101 houses a pin 102 arranged between the horns. A locking part 103 is pivotably mounted about said pin 102. This locking part 103 includes a body 104 that extends along pin 102. A first strip 105 extends from body 104 in a substantially identical direction to that of inclined cover 101. This first strip 105 includes a hook 106 at the end thereof. The body 104 also includes a second strip 107, which extends in a perpendicular direction to first strip 105, away from cover 101. Body 104 also includes a projecting portion 108 that extends in an opposite direction to that of first strip 105 such that a spring 109 can be arranged between cover 101 and projecting portion 108. Consequently, pressing on second strip 107 causes body 104 to pivot and consequently pivots first strip 105 and causes spring 109 to contract as shown in FIG. 7.

When idle, this first strip 105 extends in a substantially identical direction to that of inclined cover 101. The width of bracelet or strap 110 is equal to the width between the horns. Each end 111 of the bracelet or strap includes a slot 112 which is made to be coupled with inclined cover 101. When the bracelet or strap is coupled with inclined cover 101, locking part 103 is placed in the working position to facilitate coupling, with spring 109 contracted. Once the bracelet or strap has been coupled to inclined cover 101, locking part 103 is placed in the idle position such that hook 106 of first strip 105 is cooperating with locking member 113 of the bracelet or strap so that the latter does not come undone.

One drawback of this object is that it is complex. Indeed, it requires significant transformations; since the case and the bracelet or strap are greatly altered compared to a basic watch and additional costs are therefore generated.

Another drawback is that if one of the securing system parts breaks, such as one of the strips or the spring, replacement thereof is complex, long and expensive. In fact, it is necessary to go to a professional so that he can replace the damaged parts.

SUMMARY OF THE INVENTION

The invention concerns a portable object which overcomes the drawbacks of the prior art by providing a portable object that includes a system for securing the bracelet or strap to the case of said portable object, which is simple, quick to use and manufacture and enables the bracelet or strap to be replaced easily and inexpensively.

Thus the invention concerns the aforecited portable object which is characterized in that it includes securing means. This securing means includes a locking part inserted in each end of the bracelet or strap and at least one groove located on the middle part. The securing means is arranged to allow each end of the bracelet or strap to penetrate the space defined by the middle part and the horns of each pair connected by said guide element and to cooperate elastically with said groove and with the guide element for the locking thereof.

Advantageous embodiments form the subject of claims 2 to 19.

A first advantage of these embodiments is that they allow the bracelet or strap to be changed quickly and simply. Indeed, the securing means includes a locking part comprising a support in which a resilient element is secured. The support is inserted in the strand at the end thereof. The resilient element includes a main plate from which extend two parallel branches, bent to form, with the main plate, an angle of more than zero. Each branch includes a hook cooperating with the groove in the middle part. An application of pressure on the branches has the effect of moving the branches closer towards the main plate until the facing surfaces of the branches and the main plate are in contact. This allows the bracelet or strap strand to be easily secured to the case since just a simple application of pressure on the branches of the resilient element is required to insert said bracelet or strap strand into the space defined by the middle part and the horns connected by the guide element. Unlocking is carried out by applying pressure to the branches. This resilient element thus requires only a simple manipulation by the user to lock or unlock the attachment of the bracelet or strap to the case.

Another advantage is that the securing system is very practical. The system includes a support inserted at each end of the bracelet or strap. A resilient element for locking the bracelet or strap to the case is inserted in said support. Thus, if the support and resilient element form only one part, costs are reduced since there is a smaller number of moulds. If these two parts are separate, it is possible to replace the resilient element if it becomes damaged. The user need then only replace the resilient element and not the entire bracelet or strap.

Moreover, the fact of having two separate parts means that these parts can be made of different materials. This thus means that the resilient element can be made of a material with different mechanical properties to that of the support. Consequently, it is possible to have a support made of a hard, but light material and a resilient element made of a material that wears less and thus lasts longer.

BRIEF DESCRIPTION OF THE DRAWINGS

The objects, advantages and features of the portable object will appear more clearly in the following detailed description of at least one embodiment of the invention given solely by way of non-limiting example and illustrated by the drawings, in which:

FIG. 2 shows schematically a top view of the first embodiment of the portable object according to the present invention;

FIGS. 3 and 4 show schematically the resilient element according to the present invention;

FIG. 5 shows schematically a variant of the resilient element according to the present invention;

DETAILED DESCRIPTION OF THE INVENTION

In the following description, those parts of the portable object that are well known to those skilled in this technical field will only be explained in a simplified manner.

Figure 1:
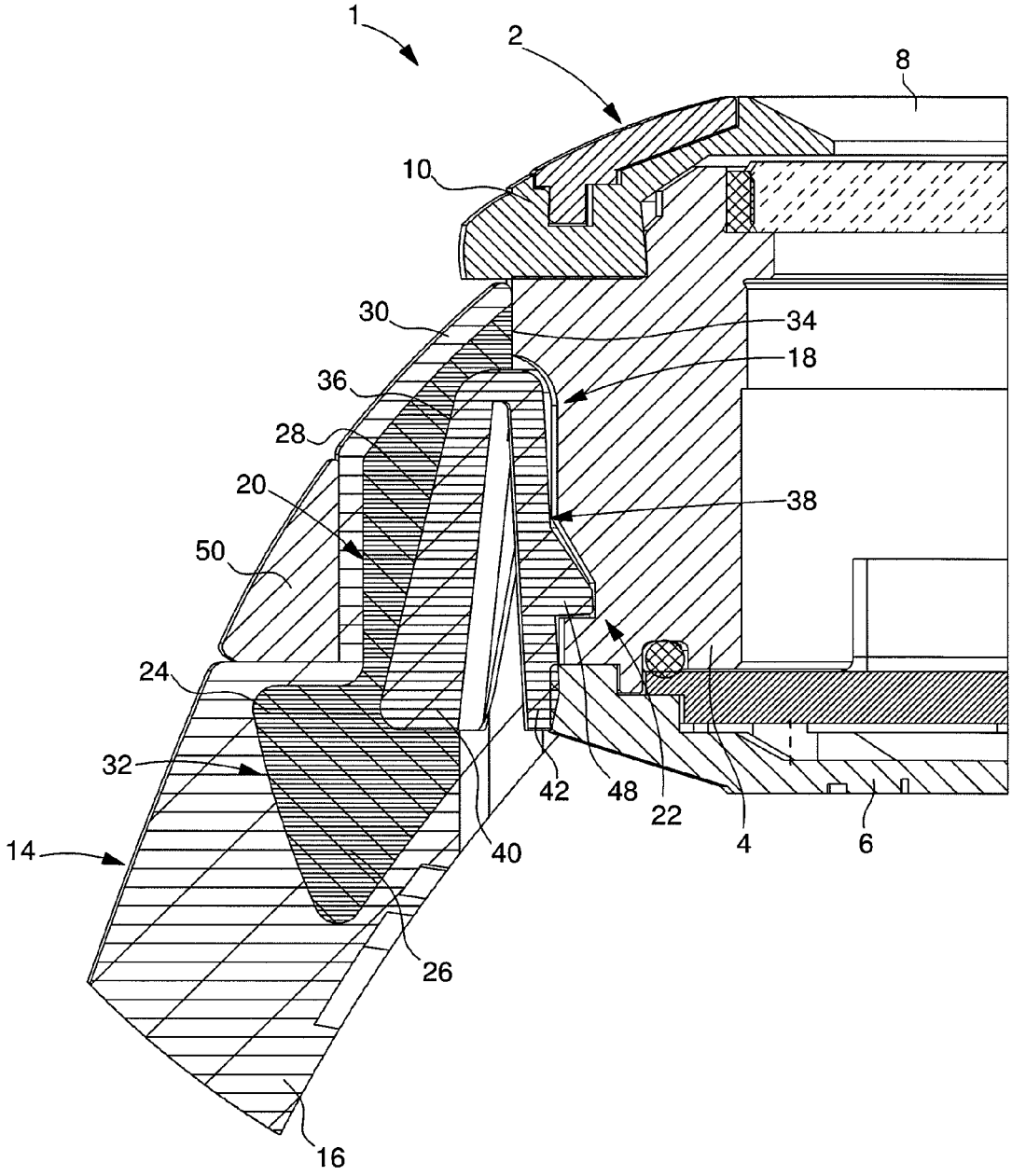
FIG. 1 shows schematically a first embodiment of the portable object according to the present invention.

FIGS. 1 and 2 show views of a first embodiment of portable object 1 according to the present invention. This portable object 1 takes the form here of a timepiece. It will also be clear that portable object 1 may take, for example, the form of a portable heart rate monitor or a pedometer.

This portable object 1 includes a case 2. Case 2 is formed of a middle part 4 closed by a back cover 6 and a crystal 8. Case 2 also includes a bezel 10 arranged on the middle part 4 and carrying crystal 8. Bezel 10 may or may not be a rotating bezel.

Middle part 4 includes horns 12 for securing a bracelet or strap 14 to said portable object 1 so that the latter can be attached to the user's wrist. These horns 12 are connected to each other by a guide element 50 joining them so as to define a space or aperture in conjunction with the middle part. This guide element 50 may take the form, for example, of a bar or a plate. Bracelet or strap 14 takes the form of two bracelet or strap strands 16 connected to each other by a fastening system, such as an unfolding buckle. Each bracelet or strap strand 16 is fixed to case 2 by securing means 18.

The present invention proposes a system for fixing said bracelet or strap 14 to case 2 simply and quickly.

Bracelet or strap 14 is form of strands 16 made, for example, of a flexible material such as rubber or silicon. Securing means 18 includes a locking part 20 fixed to bracelet or strap strand 16. This locking part 20 cooperates with a groove 22 located on middle part 4 of case 2.

The locking part 20 includes a support 24. This support includes a base 26 from which a head 28 extends. The section of base 26, at the junction between said base 26 and head 28, is different and preferably larger than the section of head 28. Support 24 is inserted into strand 16 at the end 30 thereof. To achieve this, end 30 of bracelet or strap strand 16 is arranged to have a recess 32 into which support 24 is inserted. This recess 32 is made so that base 26 of support 24 is almost entirely or entirely enveloped by bracelet or strap strand 16. For this purpose, base 26 could be given a substantially triangular profile, the section at the junction between base 26 and head 28 being larger than the section at the end of base 26. This arrangement allows better positioning of support 24 without altering the hold thereof in bracelet or strap strand 16. Moreover, this allows the profile of bracelet or strap strand 16 to be made slimmer.

Recess 32 is also arranged so that head 28 of support 24 is only partially enveloped such that, when bracelet or strap strand 16 is attached to case 2, the surface 34 of head 28 facing middle part 4 is not enveloped by said bracelet or strap strand 16. This surface 34 thus includes a housing 36 where a resilient element 38 is housed. Head 28 of support 24 has an identical or substantially identical shape to that of the space defined by horns 12 and the guide element 50 that connects said horns, so that head 28 can easily be inserted in said space.

Resilient element 38, shown in FIGS. 3 and 4, includes a main plate 40 of substantially parallelepiped shape so that main plate 40 can be housed in housing 36 of head 28 of support 24. At least two branches 42 extend from this main plate 40, in parallel or substantially in parallel. The length of these branches 42 is substantially the same as that of main plate 40. The two branches 32 are folded over in the direction of main plate 40 so that an angle of more than zero is formed between branches 42 and main plate 40 or so that a space remains between branches 42 and main plate 40. An inner profile 44 is thus delimited by the facing surfaces of branches 42 and main plate 40 of resilient element 38. An outer profile 46 is delimited by the outer surfaces of branches 42 and main plate 40 of resilient element 38. This arrangement enables resilient element 38 to have elasticity. Indeed, this elasticity is observed in the case where, after force is applied to branches 42 in the direction of the main plate 40, it is noted that branches 42 return to their initial positions as soon as said force is not longer being applied. Resilient element 38 further includes two hooks 48 each extending over the outer profile 46 of one of branches 42. Each hook 48 preferably has a substantially identical shape to a right angled trapezium.

Of course, it will be clear that hooks 48 are not necessarily located at the ends of branches 42 and that the length of branches 42 can be greater than that of main plate 40.

Resilient element 38 is inserted into housing 36 of support 24 such that hooks 48 are oriented towards the exterior of support 24 and project relative to the profile of head 28 of support 24. Resilient element 38 can be inserted by being driven in, bonded or any other means that achieves the same result. Said resilient element 38 can also be arranged to be easily removed from housing 36 for replacement.

When bracelet or strap 14 is fixed to case 2, head 28 of support 24 including resilient element 38 is inserted into the space defined by horns 12 and guide element 50 that connects said horns. Since head 28 of support 24 has a substantially identical shape to that of the space defined by horns 12, guiding occurs perfectly. Since hooks 48 project relative to the profile of head 28 of support 24, during insertion, case 2 exerts pressure on branches 42. This results in branches 42 moving closer towards main plate 40 until the opposite surfaces of branches 42 and main plate 40 enter into contact. Hooks 48 no longer project relative to the profile of head 28 of support 24. Insertion is thus made easier since there is no obstacle to slow it down or interfere with it.

To stop the insertion of head 28 and thus of support 24, base 26 is used as a stop member. Indeed, as stated above, at the junction thereof with head 28, base 26 has a larger section than that of head 28. This section is thus arranged to offer a surface that can come into contact with horns 12 and/or guide element 50. In practice, a contact will be arranged between horns 12 and/or guide element 50 with this surface of rubber coated base 26 of bracelet or strap 14, to define the end insertion position of said strand 16 in the space defined by horns 12, middle part 14 and guide element 50.

When the insertion is in a state wherein base 26 acts as stop member, groove 22 located on middle part 4 is cleverly positioned such that the force exerted on branches 42 is no longer exerted and the hooks of branches 42 can be housed in said groove 22. Consequently branches 42 return to their initial positions. This clever positioning, combined with the fact that head 28 is of identical or substantially identical shape to the space defined between horns 12, enables said bracelet or strap 14 to be fixed and held on case 2.

Head 28 of identical or substantially identical shape to the space defined by middle part 4 and horns 12 connected by guide element 50 not only allows perfect guiding of said head 28 into said space, but also good horizontal and lateral holding therein. Vertical holding is achieved by hooks 48 and base 26 which respectively prevent any movements from the top downwards and from the bottom upwards.

To remove bracelet or strap 14 from case 2, a very simple manoeuvre has to be carried out. This manoeuvre consists in acting on resilient element 38.

To remove a bracelet or strap strand 16, the user acts on resilient element 38 so as to exert force on branches 42. The result of this pressure is that branches 42 move closer towards main plate 40 until the facing surfaces of branches 42 and main plate 40 are in contact. Hooks 48 then no longer project relative to the profile of head 28 of support 24 and thus are no longer housed in groove 22. The user can then pull on said strand 16 so as to remove it from the space defined by horns 12.

In order to facilitate pressure on branches 42, the length of said branches can be made greater than that of plate 40 so that the contact surface with the user's finger is larger. Likewise, it is possible to provide a notch in middle part 4 and/or back cover 6. This notch enables the user to reach branches 42 more easily and thus facilitates pressure on branches 42.

In a first variant of this first embodiment, resilient element 38 and support 24 can be made of different material. Indeed, since these two elements have different functions, the constituent materials of these elements may be adapted in accordance with each part. Thus, if support 24 has to be rigid to undergo mechanical stress without deforming, the resilient element must be formed of a material that deforms easily without having an elastic limit that is too low and will lose its effect. One can thus, for example, make support 24 either of metal or an alloy and resilient element 38 of plastic or vice versa. Likewise, support 24 and resilient element 38 can both be made of metal or an alloy but of different types, for example rigid and light for support 24 and flexible for resilient element 38. This possibility also optimises costs because different materials at different costs can be used.

In a second variant in which the bracelet or strap strands 16 are made either of metal or an alloy, support 24 can also be made of metal or an alloy. In this case, it is entirely possible to envisage support 24 being directly integrated in bracelet or strap strand 16. This arrangement reduces costs since a single mould is used, but also simplifies the method since the step of setting support 24 in place in said strand 16 is performed directly during manufacture.

In a third variant shown in FIG. 5, resilient element 38 can have only one branch 42. This single branch 42, the width of which is at most equal to that of main plate 40, includes at least one hook 48. The advantage of this variant is that it allows pressure to be applied on branches 42 in an even simpler manner, since there is only one branch 42 to manipulate, and the latter is wide and thus easy to handle. Moreover, this allows the manufacturing mould to be simplified since the width of branch 42 is preferably the same as that of main plate 40.

Figure 6:
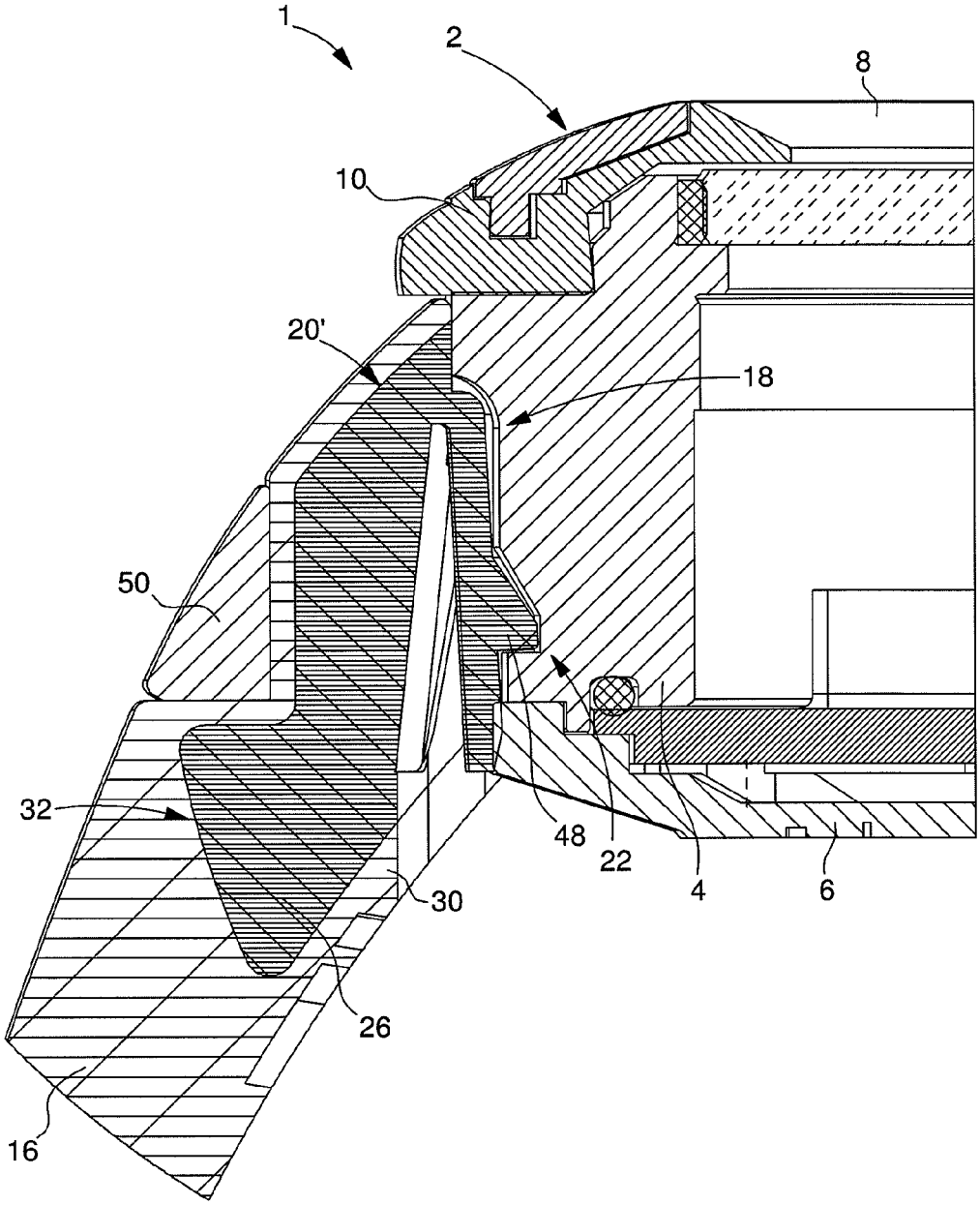
FIG. 6 shows schematically a second embodiment of the portable object according to the present invention.
Figure 7:
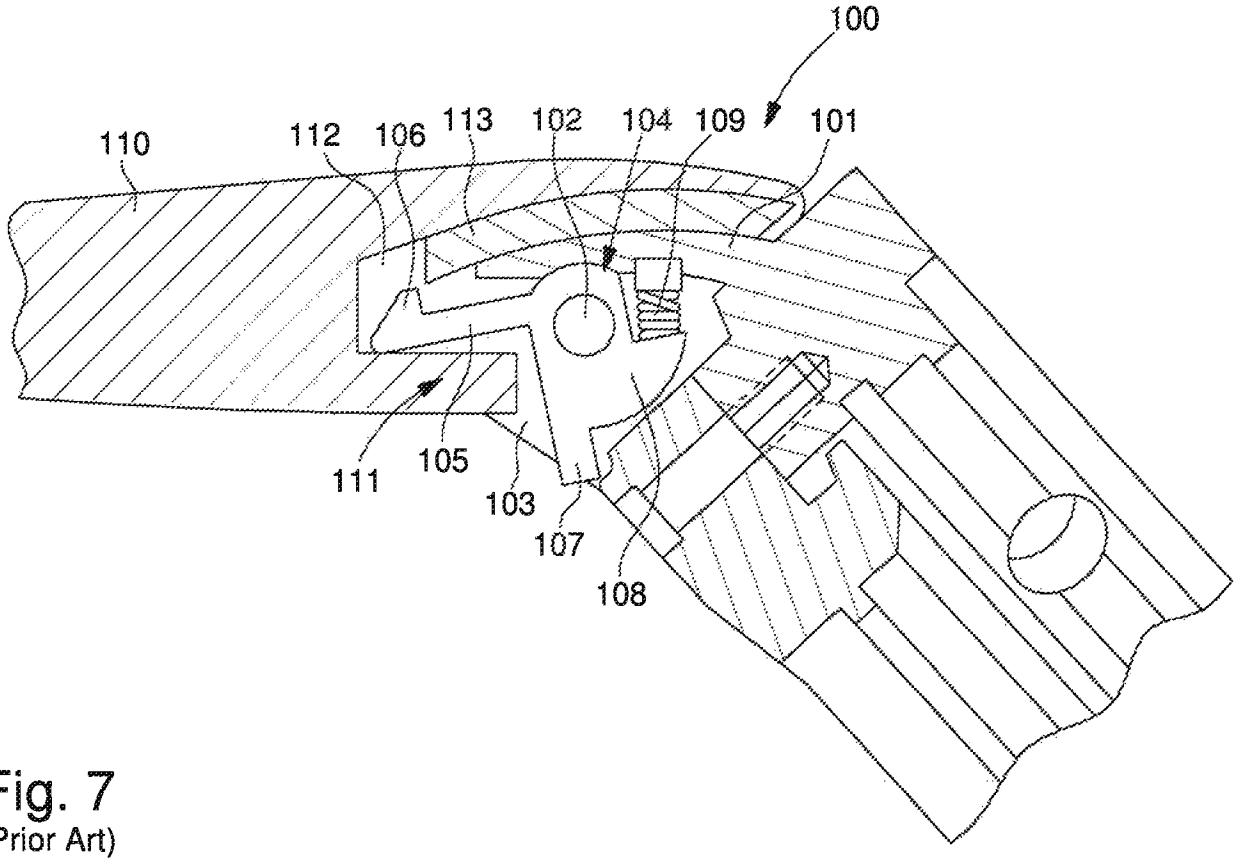
Fig. 7 (Prior Art)
FIG. 7 shows schematically a portable object with a system for securing a bracelet or watch according to the prior art.

According to a second embodiment of the invention shown in FIG. 6, resilient element 38 and the support, forming locking part 20', are one and the same part. This arrangement has the advantage of simplifying the manufacturing method and also reducing costs. Indeed, the advantage of this arrangement is that it requires only one step for making locking part 20' whereas to make locking part 20 according to the first embodiment, three steps are necessary: one step for manufacturing support 24, a step for manufacturing resilient element 38 and a step for assembling resilient element 38 on support 24, thereby forming locking part 20. Hence the method not only becomes simpler and quicker but also less expensive since, again, the number of moulds is smaller and the assembly line is simpler. It will be clear that this locking part 20' can be made by any possible method such as moulding, machining or other. Locking part 20' can be made of metal or an alloy or of plastic, the only condition being that the material forming locking part 20' is rigid.

In a first variant of this second embodiment, bracelet or strap 14 can be made of metal or an alloy. Hence if locking part 20' is made of metal or an alloy, locking part 20' can be made at the same time as said bracelet or strap strands 16 so as to form a single part. The advantage obtained is a reduction in costs since a single mould is used, but also a simplification of the method since the step of setting locking part 20' in place in said strand 16 is performed directly during manufacture.

In a second variant of this second embodiment, resilient element 38 forming a single part with support 24 can have only one branch 42. The advantage of this variant is that it allows pressure to be applied to branches 42 in an even simpler manner since there is only one branch 42 to manipulate, the latter preferably being wide and thus easy to handle. Moreover, this simplifies the manufacturing mould since locking part 20' is less complex.

In another variant, the space defined by the middle part and horns 12 connected by guide element 50 may not be a through space so that said space is only open on one side. This arrangement thus enables locking part 20, 20' to be hidden. This also avoids interfering with the attractiveness of the portable object while reducing constraints as regards the shape of locking part 20, 20'.

It will be clear that various alterations and/or improvements and/or combinations evident to those skilled in the art can be made to the various embodiments of the invention set out above without departing from the scope of the invention defined by the annexed claims. In fact, resilient element 38 can of course include more than two branches 42. The branches can also include several hooks 48 cooperating with several grooves 22.

What is claimed is:

1. A portable object including a case and a bracelet or strap, said case including a middle part from which two pairs of horns extend, the horns of each pair being connected by a guide element defining a space in conjunction with the middle part, wherein said portable object includes securing means including a locking part inserted in each end of the bracelet or strap and at least one groove located on the middle part, said securing means being arranged to allow each end of the bracelet or strap to penetrate the space defined by the middle part and the horns of each pair connected by said guide element and to cooperate elastically with said groove and with the guide element for the locking thereof, wherein the locking part includes a support inserted in each end of the bracelet or strap and a resilient element cooperating with the groove located on the middle part of the portable object to hold the bracelet or strap in said space, wherein the support includes a base from which a head extends, the support being inserted in one end of the bracelet or strap such that, when the bracelet or strap is secured to the case, the head occupies the space defined by the middle part and the horns of each pair connected by a guide element, and wherein the surface of the head opposite the middle part during the securing operation, includes a housing in which the resilient element is secured.

2. The portable object according to claim 1, wherein said resilient element includes a main plate from which extends at least one branch folded over to form, with the main plate, an angle of more than zero, and wherein said branch includes at least one hook cooperating with said at least one groove of the middle part.

3. The portable object according to claim 2, wherein said resilient element includes two branches which extend in the same direction and in parallel from the main plate and are folded over in the same direction, and wherein each of the two branches includes at least one hook cooperating with said groove of the middle part.

4. The portable object according to claim 1, wherein a section of the base is larger than that of the head at a junction between said base and said head, so as to serve as a stop member.

5. The portable object according to claim 1, wherein said resilient element is secured to the support by being driven therein.

6. The portable object according to claim 1, wherein said resilient element is secured to the support by bonding.

7. The portable object according to claim 1, wherein the resilient element and the support are made of an identical hard material.

8. The portable object according to claim 1, wherein the resilient element and the support are made of a different hard material.

9. The portable object according to claim 1, wherein the support comprises a substantially triangular base from which a head extends and wherein a section of the base is larger than that of the head at a junction between said base and said head forming a stop member.

10. The portable object according to claim 9, wherein said resilient element includes a substantially parallelepiped main plate housed in a housing of the head and at least two branches which extend from the main plate in parallel and wherein the length of the branches is substantially the same as that of the main plate.

11. A portable object including a case and a bracelet or strap, said case including a middle part from which two pairs of horns extend, the horns of each pair being connected by a guide element defining a space in conjunction with the middle part, wherein said portable object includes securing means including a locking part inserted in each end of the bracelet or strap and at least one groove located on the middle part, said securing means being arranged to allow each end of the bracelet or strap to penetrate the space defined by the middle part and the horns of each pair connected by said guide element and to cooperate elastically with said groove and with the guide element for the locking thereof wherein the locking part includes a support inserted in each end of the bracelet or strap and a resilient element cooperating with the groove located on the middle part of the portable object to hold the bracelet or strap in said space and wherein said support and the resilient element form a single part.

12. The portable object according to claim 11, wherein said resilient element includes a main plate from which extends at least one branch folded over to form, with the main plate, an angle of more than zero, and wherein said branch includes at least one hook cooperating with said at least one groove of the middle part.

13. The portable object according to claim 12, wherein said resilient element includes two branches which extend in the same direction and in parallel from the main plate and are folded over in the same direction, and wherein each of the two branches includes at least one hook cooperating with said groove of the middle part.

14. The portable object according to claim 11, wherein the support includes a base from which a head extends, said support being inserted in one end of the bracelet or strap such that, when the bracelet or strap is secured to the case, the head occupies the space defined by the middle part and the horns of each pair connected by a guide element, and wherein the surface of the head opposite the middle part during the securing operation, includes the resilient element.

15. The portable object according to claim 11, wherein the section of the base is larger than that of the head at the junction between said base and said head, so as to serve as a stop member.

16. The portable object according to claim 11, wherein said support comprises a substantially triangular base from which a head extends and wherein a section of the base is larger than that of the head at a junction between said base and said head forming a stop member.

17. The portable object according to claim 16, wherein said resilient element includes a substantially parallelepiped main plate housed in a housing of the head and at least two branches which extend from the main plate in parallel and wherein the length of the branches is substantially the same as that of the main plate.

* * * * *